US006766968B2

(12) United States Patent
Rieger et al.

(10) Patent No.: US 6,766,968 B2
(45) Date of Patent: Jul. 27, 2004

(54) FUEL INJECTION VALVE

(75) Inventors: Franz Rieger, Aalen (DE); Thomas Ludwig, Huenxe (DE); Hans Schlembach, Muehlacker (DE); Gottlob Haag, Markgroeningen (DE); Ulrich Brenner, Moeglingen (DE); Michael Huebel, Gerlingen (DE); Juergen Stein, Illingen (DE); Udo Sieber, Bietigheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/204,534

(22) PCT Filed: Dec. 15, 2001

(86) PCT No.: PCT/DE01/04748

§ 371 (c)(1),
(2), (4) Date: Nov. 21, 2002

(87) PCT Pub. No.: WO02/50428

PCT Pub. Date: Jun. 27, 2002

(65) Prior Publication Data

US 2004/0074998 A1 Apr. 22, 2004

(51) Int. Cl.[7] ..... F02M 51/00

(52) U.S. Cl. ..... 239/585.1; 239/585.5; 239/533.13

(58) Field of Search ..... 239/463, 472, 239/473, 494, 496, 497, 533.2, 533.11, 533.12, 585.1, 585.4, 585.5, 333.13, 333.14

(56) References Cited

U.S. PATENT DOCUMENTS

| | | | | |
|---|---|---|---|---|
| 4,192,466 A | * | 3/1980 | Tanasawa et al. | 239/464 |
| 4,467,965 A | | 8/1984 | Skinner | |
| 4,653,694 A | | 3/1987 | Noguchi et al. | |
| 5,642,862 A | * | 7/1997 | Wakeman et al. | 239/585.4 |
| 6,145,761 A | * | 11/2000 | Muller et al. | 239/533.12 |

FOREIGN PATENT DOCUMENTS

| | | |
|---|---|---|
| DE | 29 41 536 | 4/1981 |
| DE | 197 36 682 | 2/1999 |
| EP | 0 363 162 | 4/1990 |
| EP | 0 387 085 | 9/1990 |
| EP | 1 041 274 | 10/2000 |
| JP | 09 250428 | 9/1997 |

OTHER PUBLICATIONS

Patent Abstracts of Japan, vol. 1998, No. 01, Jan. 30, 1998.

* cited by examiner

*Primary Examiner*—Michael Mar
*Assistant Examiner*—Thach H Bui
(74) *Attorney, Agent, or Firm*—Kenyon & Kenyon

(57) ABSTRACT

A fuel injector for fuel injection systems in internal combustion engines, including an actuator, a valve needle operable by the actuator for operating a valve-closure member, which, together with a valve-seat surface forms a sealing seat and a swirl device including at least one swirl channel, through which fuel flows with a tangential component relative to a longitudinal axis of the fuel injector. The axial position of a plunger element determines a cross-section of at least one bypass channel that bypasses the at least one swirl channel without a tangential component.

11 Claims, 3 Drawing Sheets

FUEL INJECTION VALVE

FIELD OF THE INVENTION

The present invention relates to A fuel injector.

BACKGROUND INFORMATION

A fuel injector for the direct injection of fuel into the combustion chamber of a mixture-compressing, spark-ignited internal combustion engine, the fuel injector including a guide and seat area formed by three disk-shaped elements at the downstream end of the fuel injector is described in German Published Patent Application No. 197 36 682. A swirl element is embedded between a guide element and a valve seat element. The guide element is used to guide an axially movable valve needle that protrudes through the guide element while a valve closing section of the valve needle cooperates with a valve seat surface of the valve seat element. The swirl element includes an inner opening area with multiple swirl channels that are not connected to the outer circumference of the swirl element. The entire opening area extends completely across the axial thickness of the swirl element.

A disadvantage of the fuel injectors described in the publication cited above is the fixedly set swirl angle which may not be adapted to the different operating states of an internal combustion engine such as partial load and full load operation. As a result, it is also not possible to adapt the cone apex angle $\alpha$ of the injected mixture cloud to the various operating states, which results in non-homogeneities during combustion, increased fuel consumption, as well as increased exhaust gas emission.

SUMMARY OF THE INVENTION

In contrast, the present invention may provide the advantage that the swirl is adjustable as a function of the operating state of the internal combustion engine, making it possible to produce a jet pattern adapted to the operating state of the internal combustion engine. This makes it possible to optimize both the mixture formation and the combustion process.

An advantage may be the configuration of the swirl-producing components, which in contrast to conventional swirl formation, are only augmented by a plunger element, which is simple to manufacture and which is slidable onto the valve needle. The plunger element may be activated by a suitable control unit, for example by a piezoelectric, electromagnetic or hydraulic manner.

It may also be an advantage that the swirl disk of the conventional swirl formation may be taken over without modification.

In addition, the funnel-shaped, recessed form of the valve-seat member, which makes it possible to deform the swirl disk elastically and accordingly adjust the swirl, is simple to manufacture.

It may be advantageous that the downstream end of the plunger element include a radial bevel, whose inclination corresponds to that of the funnel-shaped valve-seat member, as a result of which the swirl disk is uniformly deformed and non-homogeneities are prevented.

Also of advantage is the possibility to switch the plunger element into the position appropriate to the present operating state of the fuel injector independently of the lift of the valve needle.

An example embodiment of the present invention is shown in the drawings and explained in the following description.

DETAILED DESCRIPTION

Figure 1:
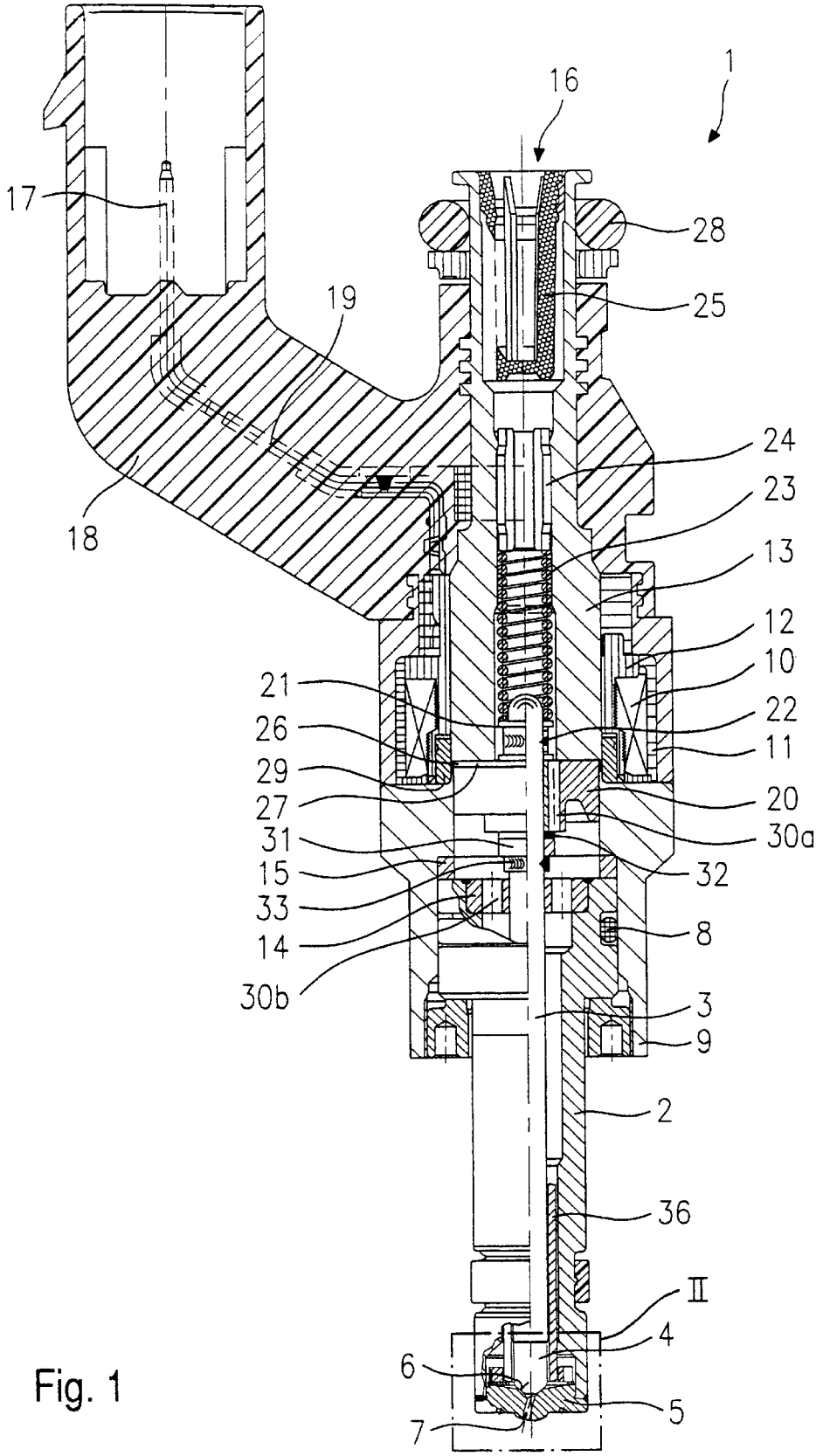
FIG. 1 shows an axial section through a first example embodiment of a fuel injector according to the present invention.

Before an example embodiment of a fuel injector 1 according to the present invention is described in greater detail based on FIGS. 2 through 5, the components of fuel injector 1 according to the present invention will be explained briefly in general terms based on FIG. 1. Fuel injector 1 is configured in the form of a fuel injector for fuel injection systems of mixture-compressing, spark-ignited internal combustion engines. Fuel injector 1 is suitable for the direct injection of fuel into a combustion chamber (not shown) of an internal combustion engine.

Fuel injector 1 includes a nozzle body 2 in which a valve needle 3 is arranged. Valve needle 3 is mechanically linked with a valve-closure member 4, which cooperates with a valve seat surface 6 arranged on a valve-seat member 5 to form a sealing seat. In the example embodiment, fuel injector 1 is an inwardly opening fuel injector 1 including at least one spray-discharge orifice 7. Nozzle body 2 is sealed off from outer pole 9 of a solenoid 10 by a seal 8. Solenoid 10 is encapsulated in a coil housing 11 and wound on a coil frame 12 which is in contact with an inner pole 13 of solenoid 10. Inner pole 13 and outer pole 9 are separated by a gap 26 and are supported by a connecting component 29. Solenoid 10 is energized by an electric current which may be supplied by an electric plug contact 17 via a line 19. Plug contact 17 is enclosed by a plastic sheathing 18 which may be extruded onto inner pole 13.

Valve needle 3 is guided in a valve needle guide 14 which is configured in the shape of a disk. A matched adjusting disk 15 is used to adjust the lift. An armature 20 is located on the other side of adjusting disk 15. Armature 20 is friction-locked to valve needle 3 via a first flange 21, valve needle 3 is connected to first flange 21 by a weld 22. A restoring spring 23 is supported on first flange 21, which in the present configuration of fuel injector 1 is pre-stressed by a sleeve 24.

A second flange 31, which is connected to valve needle 3 by a weld 33, is used as a lower armature stop. An elastic intermediate ring 32 which rests on second flange 31 prevents rebounding when fuel injector 1 is closed.

A guide disk 34, including at least one swirl channel 35, is arranged on the inlet side of the sealing seat. Together with a sleeve-shaped plunger element 36 in the example embodiment, guide disk 34 produces the swirl formation of the fuel jet, which is a function of the operating state of fuel injector 1. In the example embodiment, plunger element 36 is configured as a hollow cylinder and slipped onto valve needle 3. Using a control unit, which is not shown here, as well as an actuating mechanism, also not shown in greater detail, which, e.g., act on plunger sleeve 36 by a electromagnetic, hydraulic or piezoelectric manner, it is possible to deform swirl disk 34 elastically during the operation of fuel injector 1 so that a bypass channel 37 is closed and consequently a swirl may be produced in the fuel flowing through swirl disk 34.

As a result, the fuel flowing through fuel injector 1 in partial load operation has a lesser swirl, whereby a jet apex angle $\alpha$ of a mixture cloud injected into the combustion chamber (not shown) of the internal combustion engine is kept smaller, while in full load operation a greater swirl also produces a larger jet apex angle $\alpha$. Accordingly, the mixture may be kept richer or leaner, making it possible to achieve optimum combustion. Swirl disk 34 and the plunger element are shown in greater detail in FIGS. 2 and 4 while the mode of operation of the components is explained in FIGS. 5A and 5B.

Fuel channels 30*a* to 30*c* run in valve needle guide 14, in armature 20 and in a guide disk 42. The fuel is supplied via a central fuel supply 16 and is filtered through a filter element 25. A seal 28 seals off fuel injector 1 from a fuel line, which is not shown in greater detail.

When fuel injector 1 is in its idle state, restoring spring 23 applies force to armature 20 against the direction of its lift so that valve-closure member 4 is held in sealing contact against valve seat 6. When solenoid 10 is energized, it builds up a magnetic field which moves armature 20 in the direction of its lift against the elastic force of restoring spring 23, the lift is predetermined by a working gap 27 in the idle state, located between inner pole 12 and armature 20. Armature 20 entrains flange 21, which is welded to valve needle 3, also in the lift direction. Valve-closure member 4, which is mechanically linked with valve needle 3, lifts from valve seat surface 6 and the fuel is spray-discharged. Plunger element 36 may be controlled independently of the lift of valve needle 3 and displaced into the axial position appropriate to the particular operating state.

When the coil current is switched off, the pressure of restoring spring 23 causes armature 20 to drop away from inner pole 13 after sufficient decay of the magnetic field, as a result of which flange 21, which is mechanically linked to valve needle 3, moves against the lift direction. This moves valve needle 3 in the same direction, as a result of which valve-closure member 4 settles on valve seat surface 6 and fuel injector 1 is closed.

Figure 2:
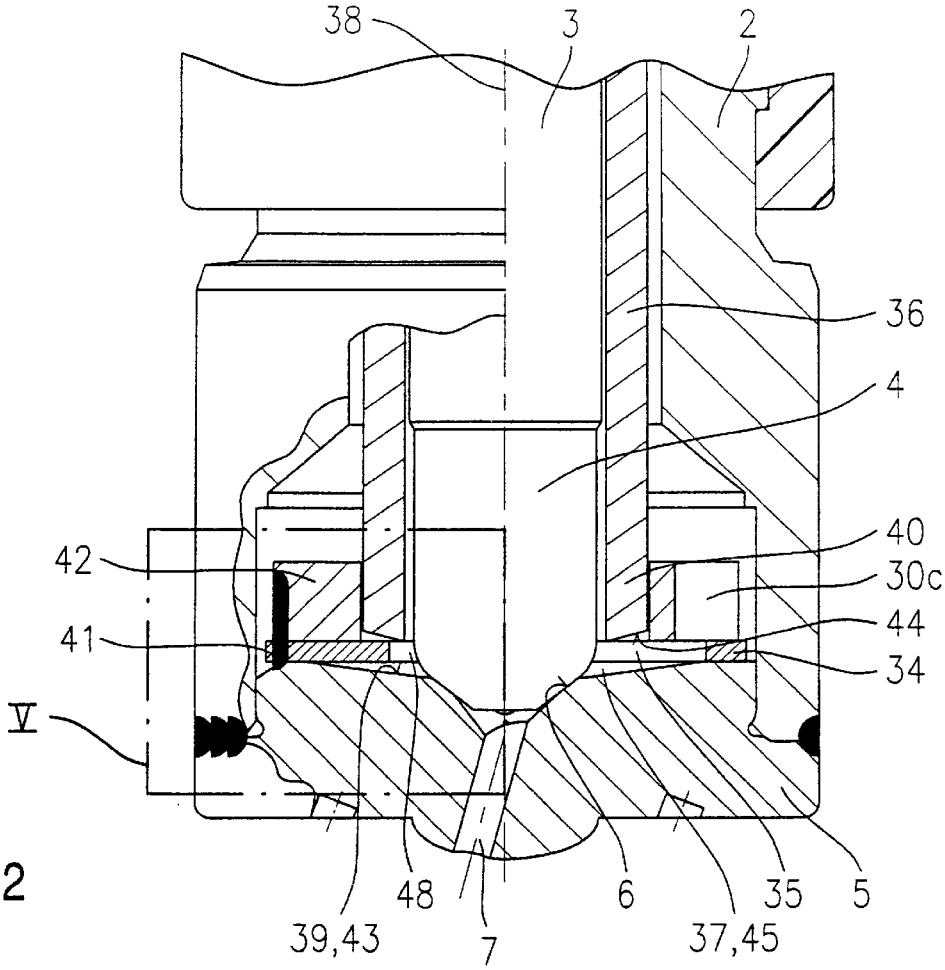
FIG. 2 shows an enlarged detail taken from the fuel injector according to the present invention in area II in FIG. 1.

In a partial, simplified axial sectional view, FIG. 2 shows fuel injector 1 configured according to the present invention in area II of FIG. 1. Elements already described are provided with matching reference symbols in all figures. In order to implement the aforementioned adjustment of the swirl, fuel injector 1 configured according to the present invention includes, in addition to plunger element 36, a funnel-shaped hollow 43 in an inlet-side face 39 of valve-seat member 5. Hollow 43 runs radially from the outside to the inside so that valve seat surface 6 closes hollow 43 off from spray-discharge orifice 7.

At a downstream end 40, plunger element 36 includes a bevel 44, the inclination of which corresponds to the inclination of funnel-shaped hollow 43.

If, when fuel injector 1 is open, fuel flows through fuel channel 30*c* formed in guide disk 42, the fuel receives a more or less strong swirl as a function of the position of plunger element 36.

In FIG. 2, plunger element 36 is in an operating position in which there is no effect on swirl disk 34, which is thus not elastically deformed. As a result, a bypass channel 37 is opened, which makes it possible for the fuel to flow radially from the outside to the inside without taking on a swirl. This is made possible by funnel-shaped hollow 43 in inflow-side face 39 of valve-seat member 5 since it causes a gap 45 to form between swirl disk 34 and valve-seat member 5. The tangential component of the fuel flow is thus very small with the result that the widening of the jet pattern of the mixture cloud injected into the combustion chamber is slight, jet apex angle $\alpha$ remains small and the mixture cloud has a high penetration capacity.

Figure 3A:
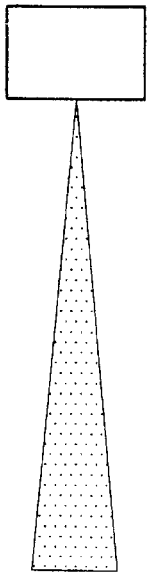
FIG. 3A shows a schematic representation of the jet apex angle $\alpha$ of a mixture cloud injected into the combustion chamber for various operating states of a fuel injector.
Figure 3B:
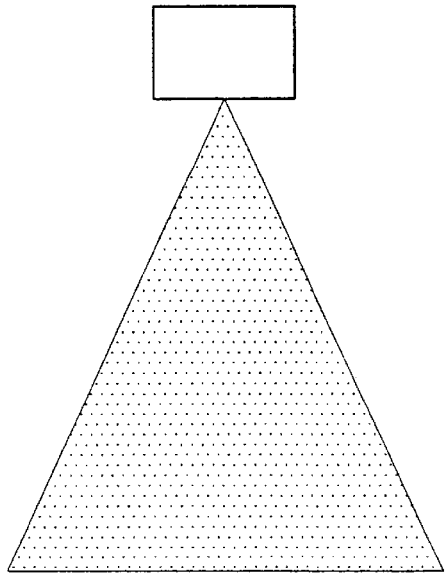
FIG. 3B shows a schematic representation of the jet apex angle $\alpha$ of a mixture cloud injected into the combustion chamber for various operating states of a fuel injector.

In order to illustrate the requirements for the mixture cloud injected into the combustion chamber for two different operating states of a fuel injector 1 (partial load range and full load range), FIGS. 3A and 3B show the desired mixture cloud formed for each case.

In partial load operation, a mixture-compressing, spark-ignited internal combustion engine places different requirements on the form, the stoichiometry and the penetration capacity of the mixture cloud injected into the combustion chamber than in full load operation. In partial load operation, the mixture cloud, as shown in FIG. 3A, should have a relatively small apex angle $\alpha$, a high penetration capacity, a narrow core area due to the small apex angle $\alpha$ with a richer mixture and a very lean envelop, while a large apex angle $\alpha$ as shown in FIG. 3B and consequently an almost homogeneous filling of the cylinder with a combustible mixture is required in full load operation.

The measures according to the present invention described here make it possible to model the parameters of the mixture cloud by influencing the swirl. If, for example, the fuel exits from spray-discharge orifice 7 with low swirl, a mixture cloud having a small apex angle $\alpha$ is injected, while a strong swirl produces a large jet widening and accordingly a mixture cloud having a large apex angle $\alpha$. It is possible to adjust the strength of the swirl through the axial position of plunger element 36.

Figure 4:
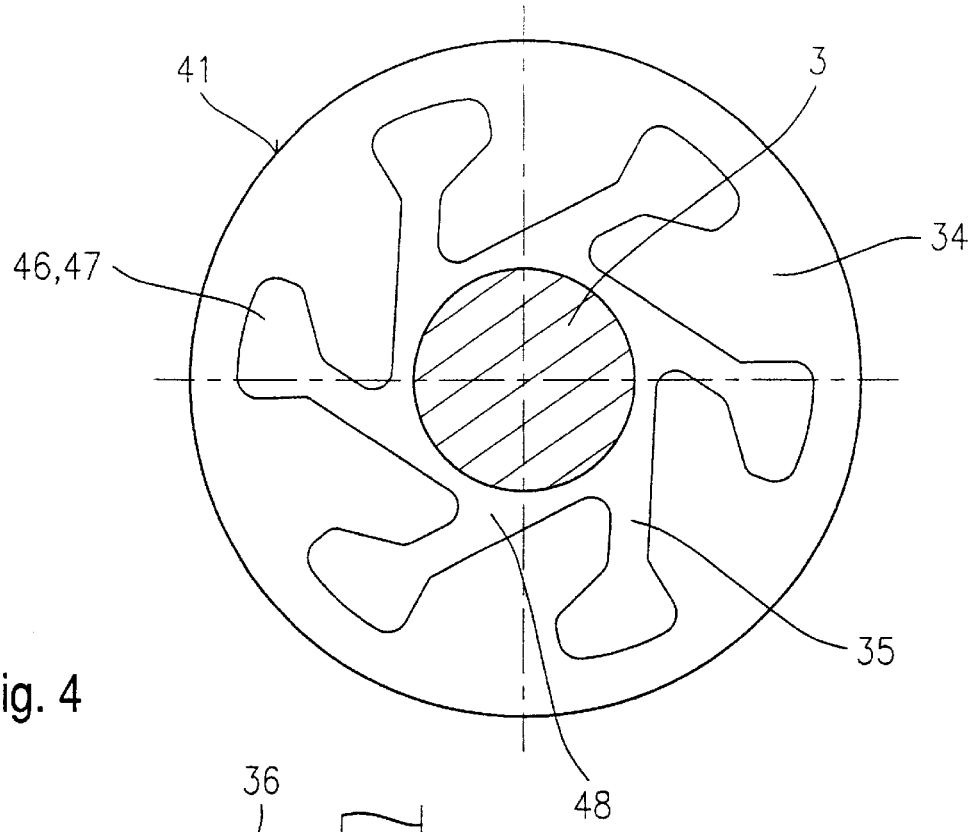
FIG. 4 shows a schematic view of an example embodiment of the swirl disk of the fuel injector according to the present invention.

In a schematic view, FIG. 4 shows an example embodiment of swirl disk 34 of fuel injector 1 according to the present invention.

The shape of swirl disk 34 illustrated in FIG. 4 includes six swirl channels 35 which are arranged in a star-shaped pattern with equal spacing. At their radial outer ends 46, swirl channels 35 include widenings 47. Valve needle 3 penetrates swirl disk 34, as a result of which a swirl chamber 48 is created between valve needle 3 and swirl disk 34, into which swirl channels 35 open.

Widenings 47 are configured and arranged in such a manner that the fuel flowing through fuel channel 30*c* enters gap 45 between valve-seat member 5 and swirl disk 34 without taking on a swirl and thus uses bypass channel 37 instead of swirl channels 35. The fuel may thus be spray-discharged without a tangential component, as a result of which the jet has the high penetration capacity required.

Figure 5A:
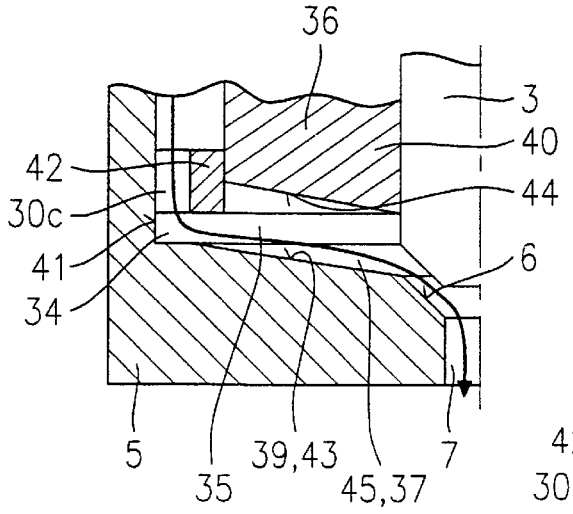
FIG. 5A shows a schematic representation of the function of the fuel injector according to the present invention in area V in FIG. 2.
Figure 5B:
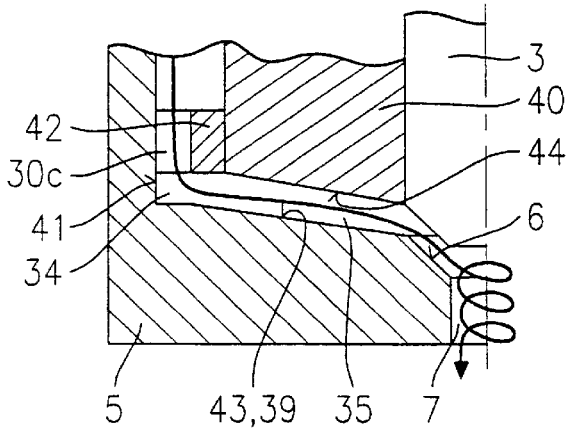
FIG. 5B shows a schematic representation of the function of the fuel injector according to the present invention in area V in FIG. 2.

In a detailed section of area V of FIG. 2, FIGS. 5A and 5B show schematically the mode of operation of plunger element 36 for swirl formation. FIG. 5A shows the position of plunger element 36 already illustrated in FIG. 2 in which there is no effect on swirl disk 34 and accordingly no swirling of the fuel. The matching of the inclination of wedge-shaped bevel 44 of the downstream end 40 of plunger element 36 with funnel-shaped hollow 43 of inflow-side face 39 of valve-seat member 5 is apparent in FIG. 5A.

If fuel injector 1 is opened by operating actuator 10 and lifting valve needle 3 off valve seat surface 6, fuel flows through fuel channel 30*c* to swirl disk 34. If plunger element 36 is not operated, swirl disk 34 is separated from valve-seat member 5 by gap 45, as a result of which it is possible for the fuel to bypass swirl channels 35 formed in swirl disk 34 and flow via outside radial widenings 47 of swirl channels 35 and through gap 45, or bypass channel 37 thus formed, to the sealing seat without swirl. The flow is indicated in FIG. 5A by an arrow.

FIG. 5B shows fuel injector 1 according to the present invention also in the open state. Compared to FIG. 5A, plunger element 36 is displaced in the downstream direction and presses on swirl disk 34. The matching inclination of bevel 44 and of hollow 43 causes swirl disk 34 to be uniformly elastically deformed by plunger element 36 and pressed against valve-seat member 5, as a result of which bypass channel 37 or gap 45 is closed and the fuel flows though swirl channels 35. As a result, the flow receives a component in the tangential direction causing fuel swirled after the sealing seat to be spray-discharged via spray-discharge orifice 7. This is also indicated in FIG. 5B by an arrow.

The present invention is not limited to the example embodiment shown and it may be used with fuel injectors 1 including piezoelectric or magnetostrictive actuators 27 and with any configuration variants of fuel injectors 1.

What is claimed is:

1. A fuel injector for a fuel injection system in an internal combustion engine, comprising:

an actuator;

a valve-seat surface;

a valve-closure member that forms a sealing seat with the valve-seat surface;

a plunger element being selectively actuatable and moveable relative to the valve needle;

a valve needle actuatable by the actuator and for operating the valve-closure member; and a swirl disk positioned upstream of the valve-seat surface with a lower portion of the valve-closure member, extending trough the swirl disk the swirl disk including at least one swirl channel through which a fuel flows with a tangential component relative to a longitudinal axis of the fuel injector, the swirl disk being elastically deformable in an axial direction upon actuation of the plunger element.

2. The fuel injector of claim 1, wherein:

an axial position of the plunger element determines a cross-section of a bypass channel that bypasses the at least one swirl channel without a second tangential component.

3. The fuel injector of claim 1, wherein:

the plunger element includes a hollow cylinder and is slipped onto the valve needle.

4. The fuel injector of claim 1, wherein:

an inlet-side face of the valve-seat member includes a funnel-shaped hollow.

5. The fuel injector of claim 4, wherein:

the sealing seat forms a lowest point of the funnel-shaped hollow of the inlet-side face of the valve-seat member.

6. The fuel injector of claim 4, wherein:

a discharge-side end of the plunger element includes a wedge-shaped bevel.

7. The fuel injector of claim 6, wherein:

the wedge-shaped bevel has a same inclination as the funnel-shaped hollow.

8. The fuel injector of claim 7, wherein:

the swirl disk is arranged between the wedge-shaped bevel and the funnel-shaped hollow and is deformed into a funnel shape by an action of the plunger element.

9. The fuel injector of claim 1, further comprising:

a guide disk, wherein:

a radially outer edge of the swirl disk is clamped between the valve-seat member and the guide disk.

10. The fuel injector of claim 1, wherein:

a swirl of the fuel flowing through the fuel injector is intensified by an axial displacement of the plunger element in a downstream direction and is weakened by an axial displacement of the plunger element against a downstream direction.

11. The fuel injector of claim 1, wherein:

an axial position of the plunger element is adjustable independently of a lift of the valve needle.

* * * * *

UNITED STATES PATENT AND TRADEMARK OFFICE

CERTIFICATE OF CORRECTION

PATENT NO. : 6,766,968 B2
DATED : July 27, 2004
INVENTOR(S) : Franz Rieger et al.

It is certified that error appears in the above-identified patent and that said Letters Patent is hereby corrected as shown below:

Column 1,
Line 5, change “A” to -- a --; and

Column 5,
Line 45, delete “trough” and insert -- through --.

Signed and Sealed this

Twenty-sixth Day of April, 2005

JON W. DUDAS
*Director of the United States Patent and Trademark Office*